United States Patent [19]

Butka

[11] Patent Number: 4,974,322

[45] Date of Patent: Dec. 4, 1990

[54] SELF SHARPENING CUTTING ELEMENT

[76] Inventor: Kemal Butka, 372 Central Park West, Apt. 20J, New York, N.Y. 10025

[21] Appl. No.: 472,206

[22] Filed: Jan. 29, 1990

[51] Int. Cl.[5] ..... B26B 3/00; B24B 33/00; B24D 3/00

[52] U.S. Cl. ..... 30/138; 30/36; 51/205 R; 51/214

[58] Field of Search ..... 30/35, 36, 37, 38, 54, 30/138, 139; 51/181 R, 205 R, 205 WG, 214; 76/82, 86, 88

[56] References Cited

U.S. PATENT DOCUMENTS

| | | | |
|---|---|---|---|
| 2,291,128 | 7/1942 | Yarrow | 30/138 |
| 2,416,929 | 3/1947 | Kjorsvik | 30/138 |
| 2,721,428 | 10/1955 | Sheets et al. | 51/205 R |
| 2,791,831 | 5/1957 | Hollis | 30/138 |
| 3,846,909 | 11/1974 | Clarke | 30/138 |
| 4,041,651 | 8/1977 | Bayly | 51/214 |
| 4,862,590 | 9/1989 | Winyard et al. | 30/138 |

*Primary Examiner*—Douglas D. Watts
*Assistant Examiner*—Paul M. Heyrana
*Attorney, Agent, or Firm*—Michael J. Striker

[57] ABSTRACT

A cutting element comprises at least one cutting member, a handle arranged for holding the cutting member, and a casing surrounding the cutting member so that in an operative position a cutting blade of the cutting member is exposed while in an inoperative position it is confined in the casing, the casing being movable relative to the cutting member so as to sharpen the blade of the cutting member.

8 Claims, 4 Drawing Sheets

FIG.6
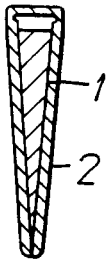
FIG.9
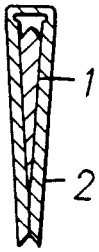
FIG.10
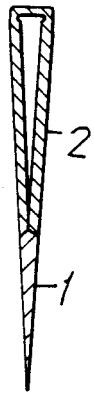
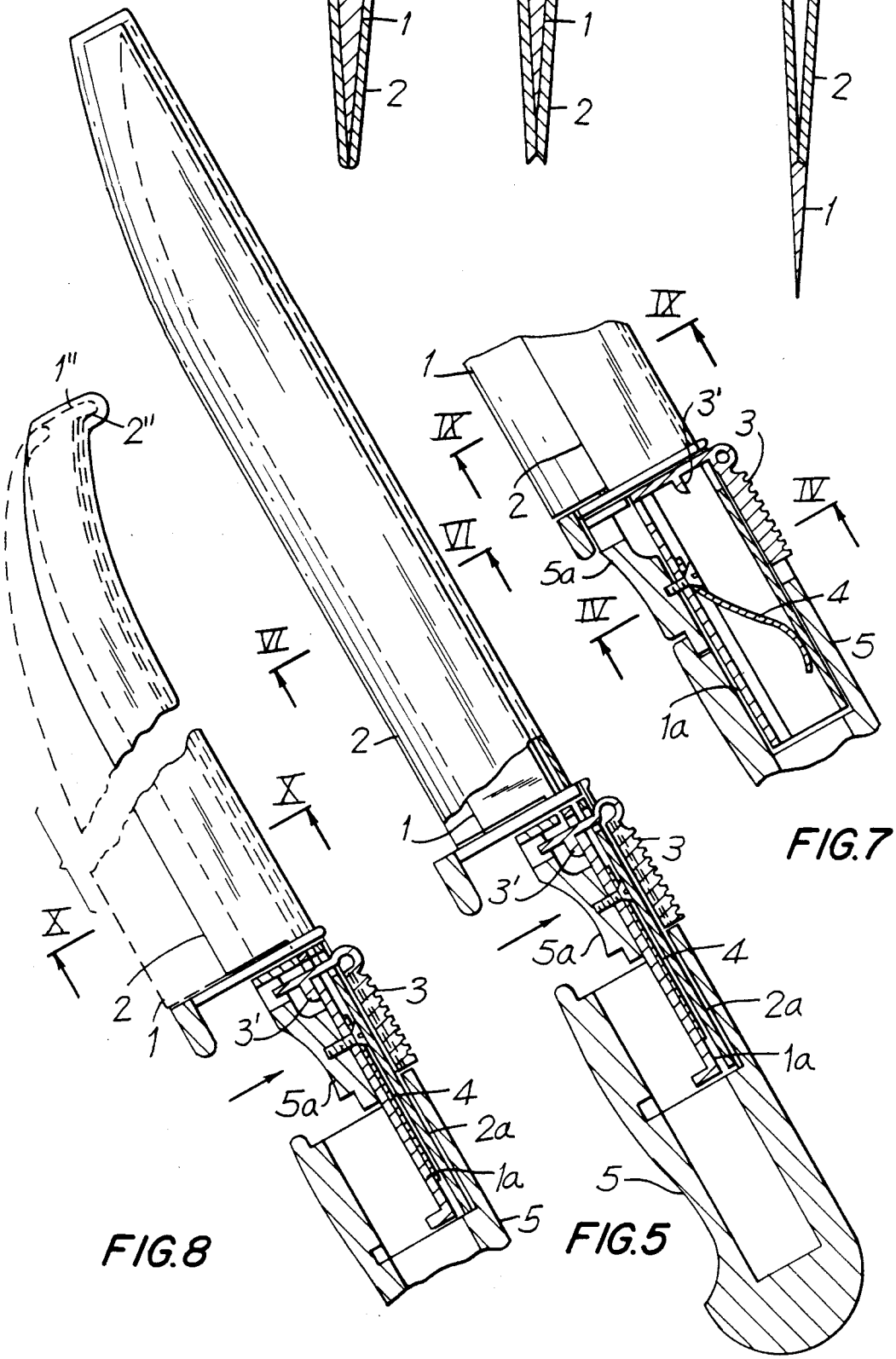
FIG.7
FIG.8
FIG.5

SELF SHARPENING CUTTING ELEMENT

BACKGROUND OF THE INVENTION

The present invention relates to cutting elements, such as knives, blades, etc.

Cutting elements are known in various shapes, forms, and operational principles. It is very important to sharpen the cutting elements after a certain service life. Many devices have been proposed for sharpening the cutting elements. Such devices as a rule, are separate devices from the cutting elements. It is believed these cutting elements can be improved so as to provide their automatic and simple sharpening after a required service life.

SUMMARY OF THE INVENTION

Accordingly, it is an object of the present invention to provide a cutting element which is self sharpening so that it can be sharpened after a desired service life without separate outside sharpening device.

It is also the object of the present invention to provide such a cutting element which is self sharpening and at the same time has a simple construction and is easy to manufacture.

In keeping with these objects and with others which will become apparent hereinafter, one feature of the present invention resides, briefly stated, in a cutting element which has an elongated cutting member; a handle for holding said elongated cutting member; a casing at least partially enclosing said cutting member so that in an operative position expose at least a cutting blade of said cutting member; and means for providing a transverse movement between said cutting member and said casing so as to sharpen the cutting blade of said cutting member during such a movement.

When the cutting element is designed in accordance with the present invention, it significantly improves the existing cutting elements in that it provides for an automatic self sharpening of the cutting member, has a simple construction and is easy and inexpensive to manufacture.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 5 is a view showing the cutting element of FIG. 1 in a different position;

FIG. 6 is a view showing a section taken along the line VI—VI in FIG. 5;

FIG. 7 is a view showing a fragment of the cutting element of FIG. 1;

FIG. 8 is a view showing the cutting element of FIG. 7 in a different position and slightly modified embodiment;

FIGS. 9 and 10 are views showing section taken along lines IX—IX and X—X in FIGS. 7 and 8;

DESCRIPTION OF THE PREFERRED EMBODIMENTS

Figures 1, 2, 3, 4:
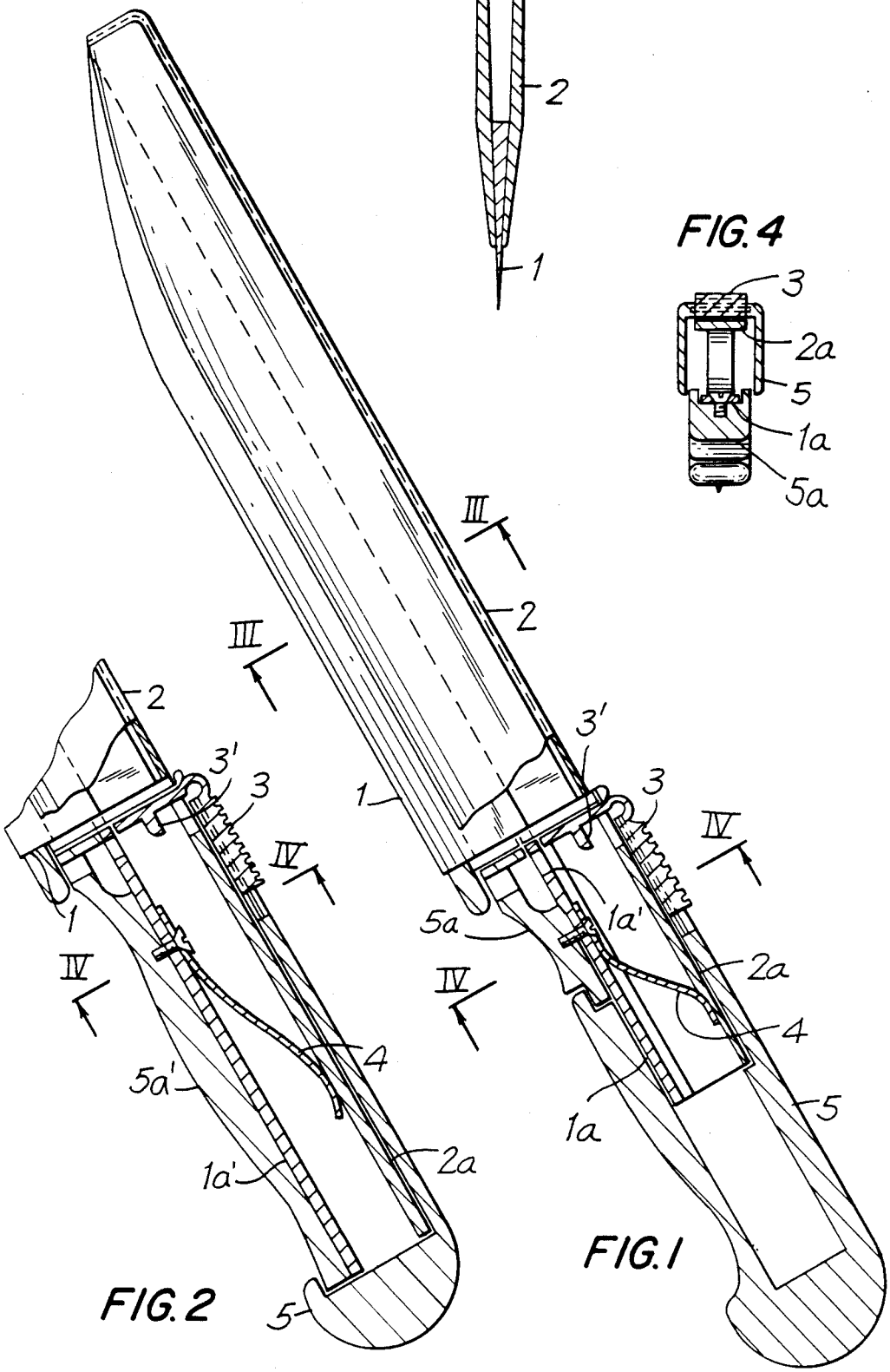
FIG. 1 is a side view of a cutting element in accordance with the present invention, formed as a knife.
FIG. 2 is a view showing a further modification of the cutting element of FIG. 1.
FIGS. 3 and 4 are views showing sections taken along the lines III—III and IV—IV in FIGS. 1 and 2.

A cutting element in accordance with the present invention is shown in FIG. 1 as a knife which has a cutting member 1, a handle 5 for holding the cutting member 1, and a casing 2 which partially surrounds the cutting member 1. The handle 5 is hollow. A projection 1*a* of the cutting member 1 extends into the interior of the handle 5 and also a projection 2*a* of the casing 2 extends into the interior of the handle. An elastic spring-like strip 4 is fixedly connected to the projection 1*a* and a movable part 5*a* of the handle for example by screw, and freely slides on the inner surface of the projection 2*a* of the casing. A regulator identified as a whole with reference numeral 3 has one portion which extends along the handle 5 and is movable in this direction, and another portion which extends transversely and has a projection 3'.

A cutting element operates in the following manner. In the position shown in FIG. 1, the regulator 3 abuts with the transverse portion against the projection 1*a* of the cutting member 1, and the projection 1*a* of the cutting member 1 together with the movable part 5*a* of the handle 5 is retained in its position shown in FIG. 1. In this position a cutting blade of the cutting member 1 is exposed and can be used for desired purposes.

The embodiment shown in FIG. 2 substantially corresponds to the embodiment of FIG. 1 with the only difference that the projection of the cutting member 1 identified with reference numeral 1*a'* and the movable part of the handle 5 which is identified with reference numeral 5*a* are longer and extend almost completely over the length of the handle. While in the embodiment of FIG. 1, the movable part 5*a* can be actuated only by one finger, in the embodiment of FIG. 2 the movable part 5*a* can be actuated by four fingers of a user.

For sharpening the blade of the cutting member 1, a user moves the regulator downwardly toward the lower end of the handle 5 as shown in FIG. 5, so that the transverse portion of the regulator releases the projection 1*a* of the cutting member 1. The user then presses the movable part 5*a* together with the projection 1*a* transversely in direction toward the regulator against the action of the strip 4. As a result, the cutting member 1 moves into the interior of the casing 2 and during this movement is sharpened by rubbing against the casing. It is to be understood that the casing is made of such a material which insures sharpening of the blade of the cutting member 1, for example a stronger and more abrasive steel than the cutting member 1. In the position shown in FIG. 5, the projection 3' of the regulator 3 engages behind the projection 1*a* of the cutting member 1 and holds the projection together with the movable part 5a of the handle in this position or in other words in an inoperative position. Thus, the casing 2 performs two functions, namely sharpening of the cutting blade of the cutting member 1 and at the same time storing the cutting member 1 in the inoperative position.

In FIG. 1 the cutting member 1 remains partly inside the casing 2' while in use. In contrast, in FIGS. 7 and 8, the cutting member is completely exposed while in use, but remains uniformly attached to the casing 2 except at the top where a small part remains inside the casing 2 so as to keep the cutting member precisely in line with the casing 2'. The above mentioned differences are illustrated in the sections shown in FIGS. 3, 6, 9, and 10.

Figures 11, 12:
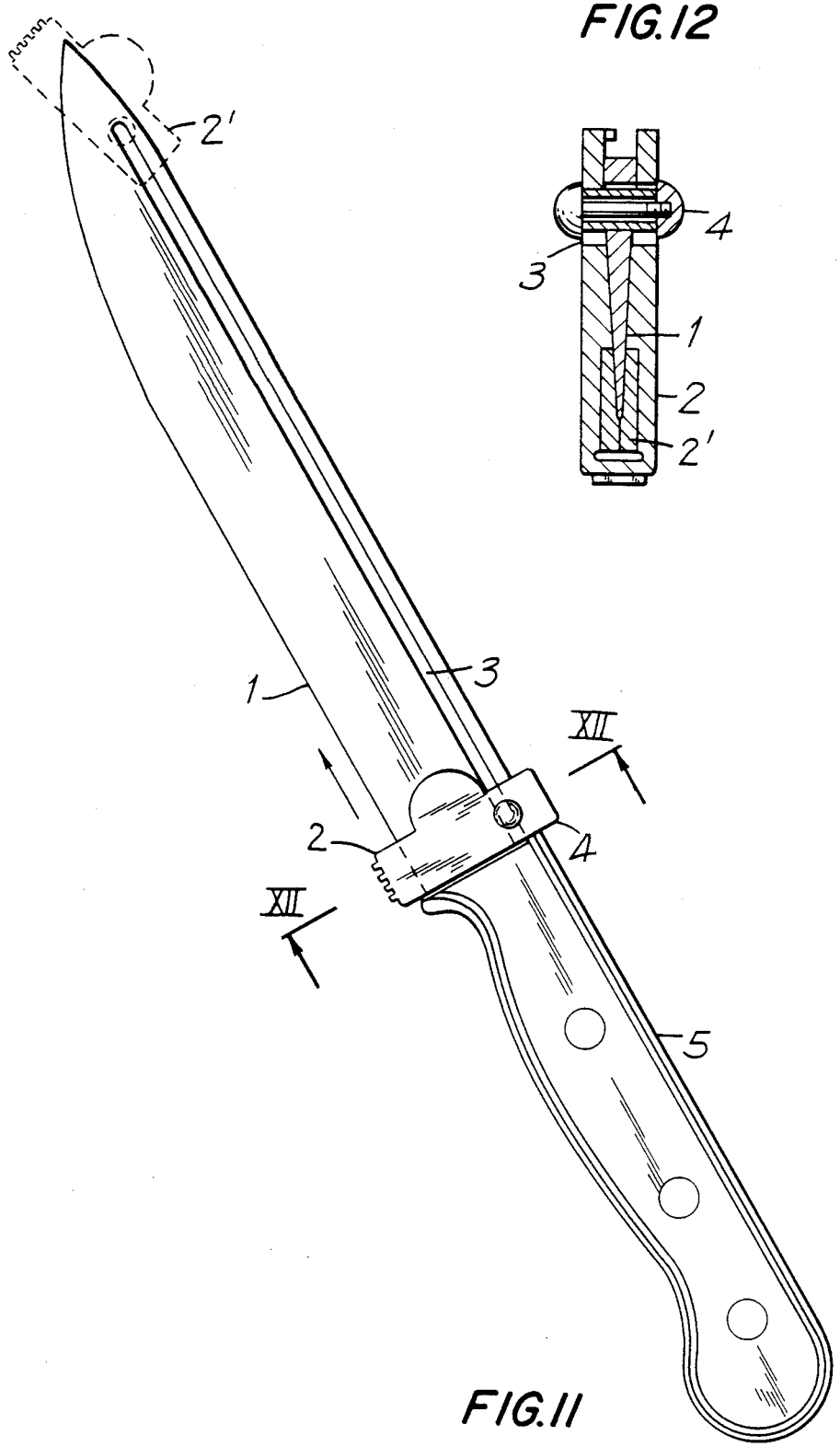
FIG. 11 is a view showing a further modification of the cutting element in accordance with the present invention.
FIG. 12 is a view showing a section of the cutting element of FIG. 11 taken along XII—XII in FIG. 11.
Figure 14:
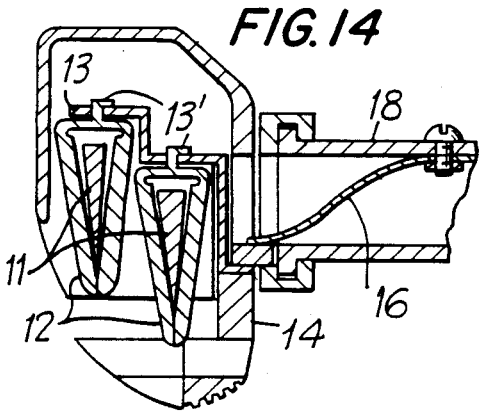
FIGS. 13 and 14 are views showing a cutting element formed as a safety razor in accordance with the present invention, in two different positions.
Figure 13:
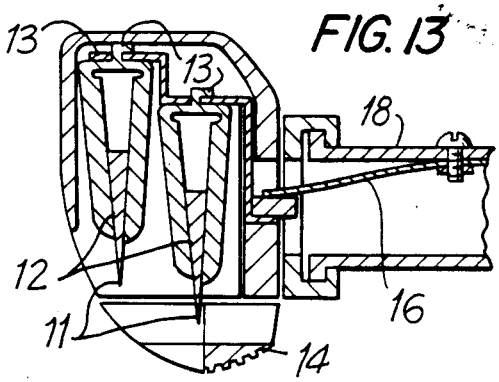
Figure 15:
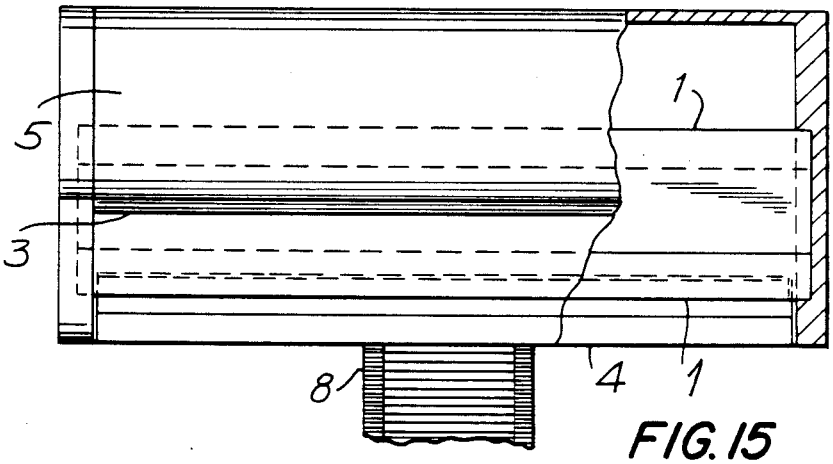
FIGS. 15 and 16 show a front elevation and a longitudinal section of the safety razor of FIGS. 13 and 14 in operative position and in an inoperative position, respectively.
Figure 16:
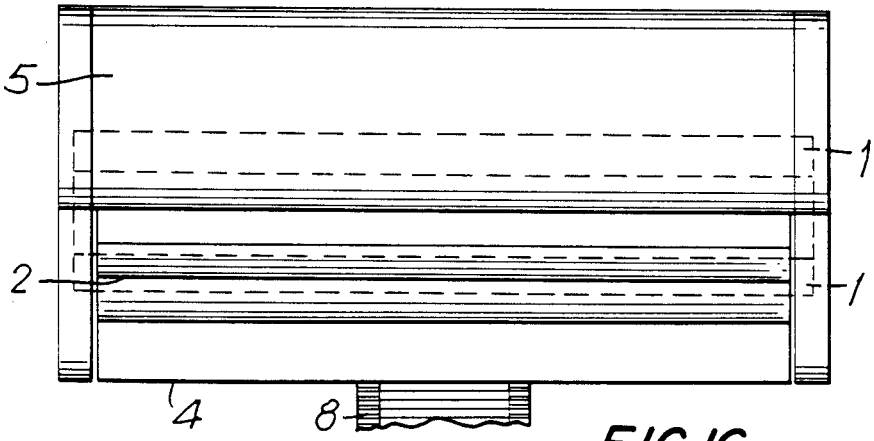

FIG. 11 shows a cutting element formed as a knife in accordance with the present invention in a somewhat different manner. Here the casing is formed as a short piece 2' which is provided with a pin engageable in a groove 3 in the cutting member 1. The sharpening is performed by displacing placing the casing 2' along the cutting memeber 1. At the upper end of the cutting member 1 the casing 2' can be turned about an axis of its pin so as to sharpen the curved upper portion of the blade of the cutting member 1. A user can hold the handle 5 in one hand and move the casing 2' by the other hand. It is also possible to hold the cutting element in one hand and displace the casing 2' by abutting against any surface and pulling the cutting element down.

FIGS. 13–16 show a cutting element in accordance with the present invention which is formed as a safety razor. The safety razor has two razor blades 11 accommodated in casings 12. The casing 12 have upper projections 13' extending through holes in a supporting strip 13 as a support 14. A handle 18 is provided with an elastic spring-like strip 16. In the position shown in FIG. 14 the blades 11 are completely confined within the casings 12. During shaving, the pressure is applied to the handle 18 and thereby the casings 12 are moved upwards and expose the blades 11 for shaving. At the same time, the sharpening of the blades is performed automatically.

It will be understood that each of the elements described above, or two or more together, may also find a useful application in other types of constructions differing from the types described above.

While the invention has been illustrated and described as embodied in a cutting element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cutting element, comprising at least one cutting member; a handle arranged for holding said cutting member; and a casing surrounding said cutting member so that in an operative position a cutting blade of said cutting member is exposed while in an inoperative position it is confined in said casing, said casing being movable relative to said cutting member so as to sharpen said blade of said cutting member, said handle having a movable portion associated with a portion of said cutting member, said movable portion of said handle together with said portion of said cutting member being movable transversely in the direction of elongation so as to move said cutting member within said operative and inoperative positions; and a regulator arranged to hold said portion of said cutting member and said portion of said handle in said operative possition of said cutting member and movable so as to release said portion of said cutting member for moving together with said portion of said handle in said transverse direction.

2. A cutting element as defined in claim 1, wherein said cutting member and said casing are elongated, said casing being movable relative to said cutting member in a direction transverse to the direction of elongation.

3. A cutting element as defined in claim 1, and further comprising an elastic element arranged to elastically urge said portion of said cutting member so as to move said portion of said cutting member together with said portion of said handle to said operative position of said cutting member.

4. A cutting element as defined in claim 1, wherein said cutting member is elongated, said casing having a length significantly smaller than the length of said cutting member and being movable along said cutting member.

5. A cutting element defined in claim 4, wherein said casing has an end position located near a tip of said cutting member and is turnable in said end position.

6. A cutting element as defined in claim 1, wherein said handle is connected with said casing and movable relative to said cutting element between said operative position and said inoperative position.

7. A cutting element, comprising at least one cutting member; a handle arranged for holding said cutting member; and a casing surrounding said cutting member so that in an operative position a cutting blade of said cutting member is exposed while in an inoperative position it is confined in said casing, said casing being movable relative to said cutting member so as to sharpen said blade of said cutting member, said handle having a movable portion associated with a portion of said cutting member, said movable portion of said handle together with said portion of said cutting member being movable transversely in the direction of elongation so as to move said cutting member within said operative and inoperative positions, said portion of said handle extending along a part of said handle so as to be actuated by one finger.

8. A cutting element, comprising at least one cutting member; a handle arranged for holding said cutting member; and a casing surrounding said cutting member so that in an operative position a cutting blade of said cutting member is exposed while in an inoperative position it is confined in said casing, said casing being movable relative to said cutting member so as to sharpen said blade of said cutting member, said handle having a movable portion associated with a portion of said cutting member, said movable portion of said handle together with said portion of said cutting member being movable transversely in the direction of elongation so as to move said cutting member within said operative and inoperative positions, said portion of said handle extending almost over a whole length of said handle so as to be actuated by several fingers of a user.

* * * * *